US005121991A

United States Patent [19]

Wakatake

[11] Patent Number: 5,121,991

[45] Date of Patent: Jun. 16, 1992

[54] STIRRING DEVICE

[75] Inventor: Koichi Wakatake, Tokyo, Japan

[73] Assignee: Kabushiki Kaisha Nittec, Tokyo, Japan

[21] Appl. No.: 685,751

[22] Filed: Apr. 16, 1991

[30] Foreign Application Priority Data

Sep. 3, 1990 [JP] Japan ..... 2-91605[U]
Dec. 25, 1990 [JP] Japan ..... 2-406720[U]

[51] Int. Cl.[5] ..... B01F 11/00
[52] U.S. Cl. ..... 366/208; 366/216
[58] Field of Search ..... 366/208, 209, 210, 211, 366/216, 217, 213

[56] References Cited

U.S. PATENT DOCUMENTS 3,682,080 8/1972 Merz ..... 366/208
3,706,443 12/1972 Oberhauser ..... 366/216

*Primary Examiner*—Robert W. Jenkins
*Attorney, Agent, or Firm*—Lowe, Price, LeBlanc & Becker

[57] ABSTRACT

A stirring device comprises a rack to hold a receptacle containing liquid, a rotor to rotate the receptacle held in the rack around the axis of the receptacle, and an oscillator having a link motion to oscillate the rack. The fluid in the receptacle is uniformly stirred by oscillation imported by the oscillator and by rotation imported by the rotor.

12 Claims, 4 Drawing Sheets

STIRRING DEVICE

FIELD OF THE INVENTION

This invention relates generally to a stirring device, and more particularly to a stirring device for an automatic sampling device set in a blood corpuscle counter, etc.

BACKGROUND OF THE INVENTION

In a conventional automatic sampling device set in a blood corpuscle counter, etc., a vacuous blood gathering tube (termed "receptacle" hereinafter) containing blood is inserted and stood in a rack for carrying, the rack is moved to a pipette in order and intermittently, and the blood is absorbed in order from the receptacle by the pipette at a blood absorbing position to be provided in a blood component test, etc.

In the conventional automatic sampling device, it is typical that a stirring device is set for the blood to be absorbed in the pipette under the condition that blood corpuscles, etc. of the blood gathered are not precipitated and separated. In the conventional stirring device, means are known in which the blood in the receptacle is stirred by rotating the receptacle around the axis thereof, by rotating and oscillating the receptacle in the lying condition, by a stirring bar to be soaked in the receptacle for a forcible stirring, and so on.

However, in the first and second means, a cap must always be put on an opening of the receptacle, and in the third means, the stirring bar must always be washed after stirring and there is a possibility of carry-over.

SUMMARY OF THE INVENTION

Accordingly, it is an object of the invention to provide a stirring device in which fluid in a receptacle, even in a receptacle to which a cap is not applied, can be uniformly stirred by a mixed stirring by rotation and oscillation of the receptacle.

To attain the above and other objects, a stirring device in the invention comprises a rack to hold a receptacle containing fluid, a rotating means to rotate the receptacle held therein around the axis of the receptacle, and an oscillating means to oscillate the rack.

According to the invention, by the rotating means, the receptacle is rotated around the axis thereof on the way to a fluid absorbing position, and at the same time, the receptacle rotated is oscillated by the oscillating means. As a result, blood corpuscles precipitated in a receptacle, even in if a cap is not applied, can be sufficiently and uniformly stirred and mixed.

Other objects and features of this invention will become understood from the following description with reference to the accompanying drawings.

BRIEF DESCRIPTION OF THE DRAWINGS

The invention will be described in more detail in conjunction with following drawings, wherein.

DESCRIPTION OF THE PREFERRED EMBODIMENT

Figure 1:
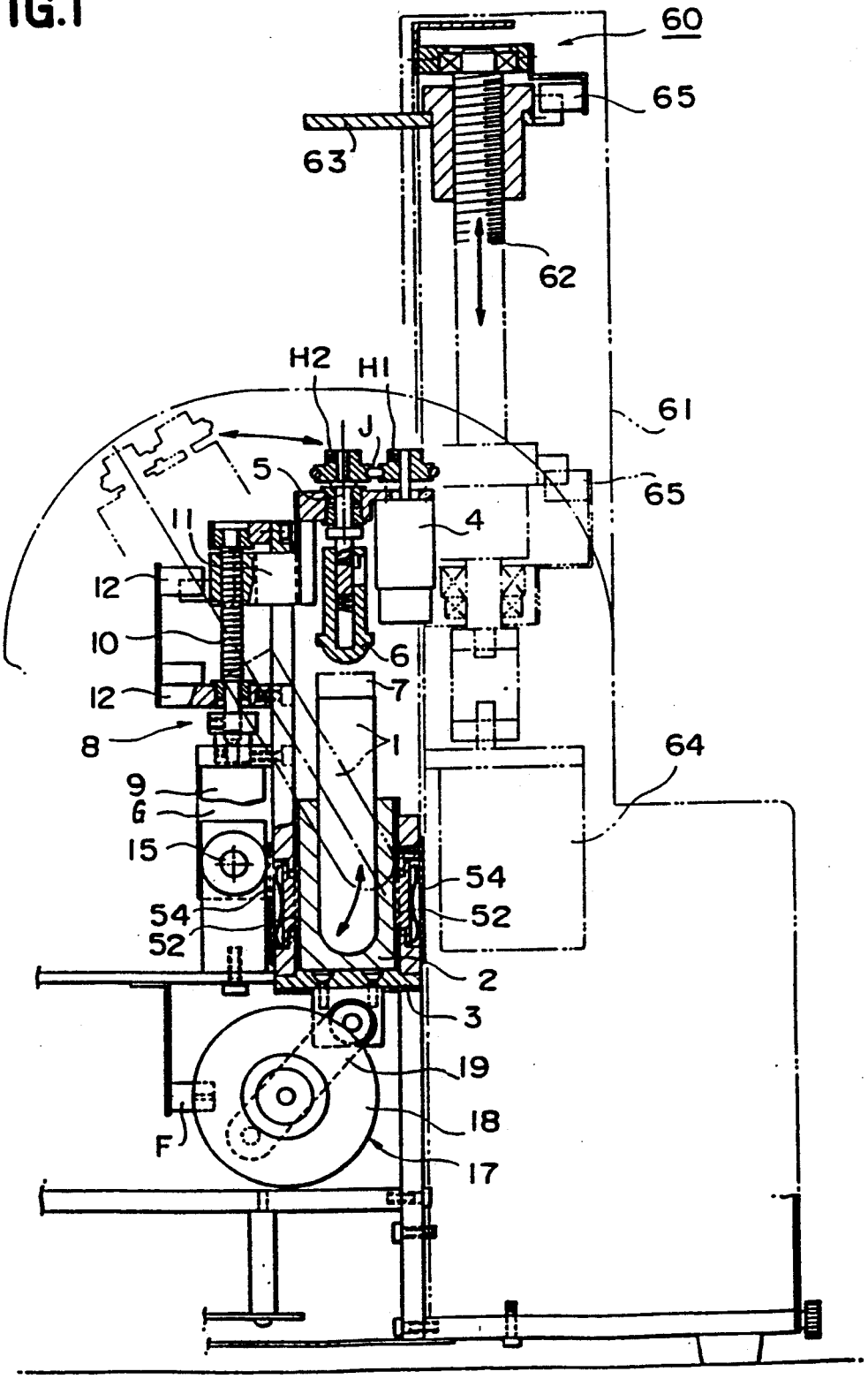
FIG. 1 is a side view showing a stirring device in a preferred embodiment of the invention, a part of which is omitted.
Figure 2:
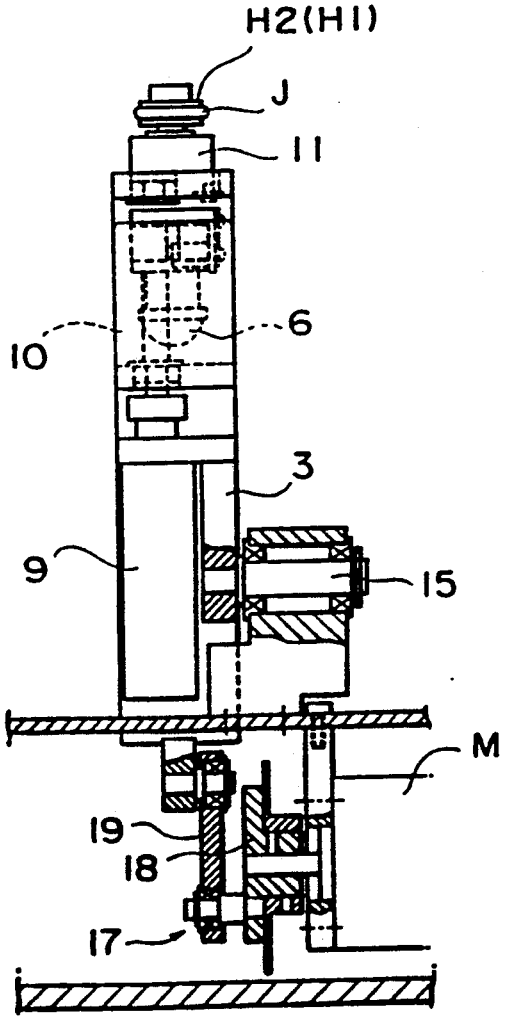
FIG. 2 is a sectional view showing a main portion of receptacle rotating and oscillating system, a part of which is omitted.

FIG. 1 and FIG. 2 show a stirring device in a preferred embodiment of the invention, wherein numeral 1 denotes a receptacle containing a sample of blood etc., numeral 2 denotes a rack to carry the receptacle 1, numeral 3 denotes an oscillator to support from the bottom and oscillate the rack 2 at a certain position, and numeral 6 denotes a rotor.

The rotor 6, set in an indented portion made in a cap 7 on the receptacle 1, rotates the receptacle 1. Rotation power of a motor 4 set in a rotor supporter 11 is transmitted to a rod 5 through a belt J wound around pulleys H1 and H2, and the rotor 6 is rotated. When the cap 7 is not applied to the opening of the receptacle 1, the rotor 6 is set directly on the opening. The rotor 6 can be reciprocated by a reciprocating device 8 located at the upper portion of the oscillator 3.

The reciprocating device 8 comprises a motor 9, a screw rod 10 to be rotated clockwise and counterclockwise by the motor 9, and the rotor support 11 to be reciprocated, gearing into the screw rod 10, as shown in FIG. 1. A base G to support the reciprocating device 8 and the rotor 6 is set on an axis 15 to be able to be oscillated. Numeral 12 in FIG. 1 denotes a limit switch located at the highest and lowest positions of the rotor supporter 11 to be reciprocated.

The oscillator 3 is set to be able to be oscillated as shown by imaginary lines in FIG. 1, with the axis 15 in the center. Oscillation is imported by a link 17 connected to the bottom of the oscillator 3.

The link 17 comprises a circle board 18 to be rotated by a motor M (shown in FIG. 2), and an effecting arm 19, one end of which is set on the circle board 18 and the other end of which is set on the bottom of the oscillator 3. By the circle board 18 rotated by the motor M, the oscillator 3 is oscillated, the axis 15 becoming a fulcrum, as shown by the imaginary lines in FIG. 1. As a result, fluid in the receptacle 1 can be oscillated and stirred. Symbol F in the figure denotes a sensor to detect a stopping position of the circle board 18.

At this time, the receptacle 1 is rotated by the rotor 6. Accordingly, the fluid in the receptacle 1 is uniformly stirred by oscillating motion imported by the oscillator 3 and by rotary motion imported by the rotor 6.

Figure 3:
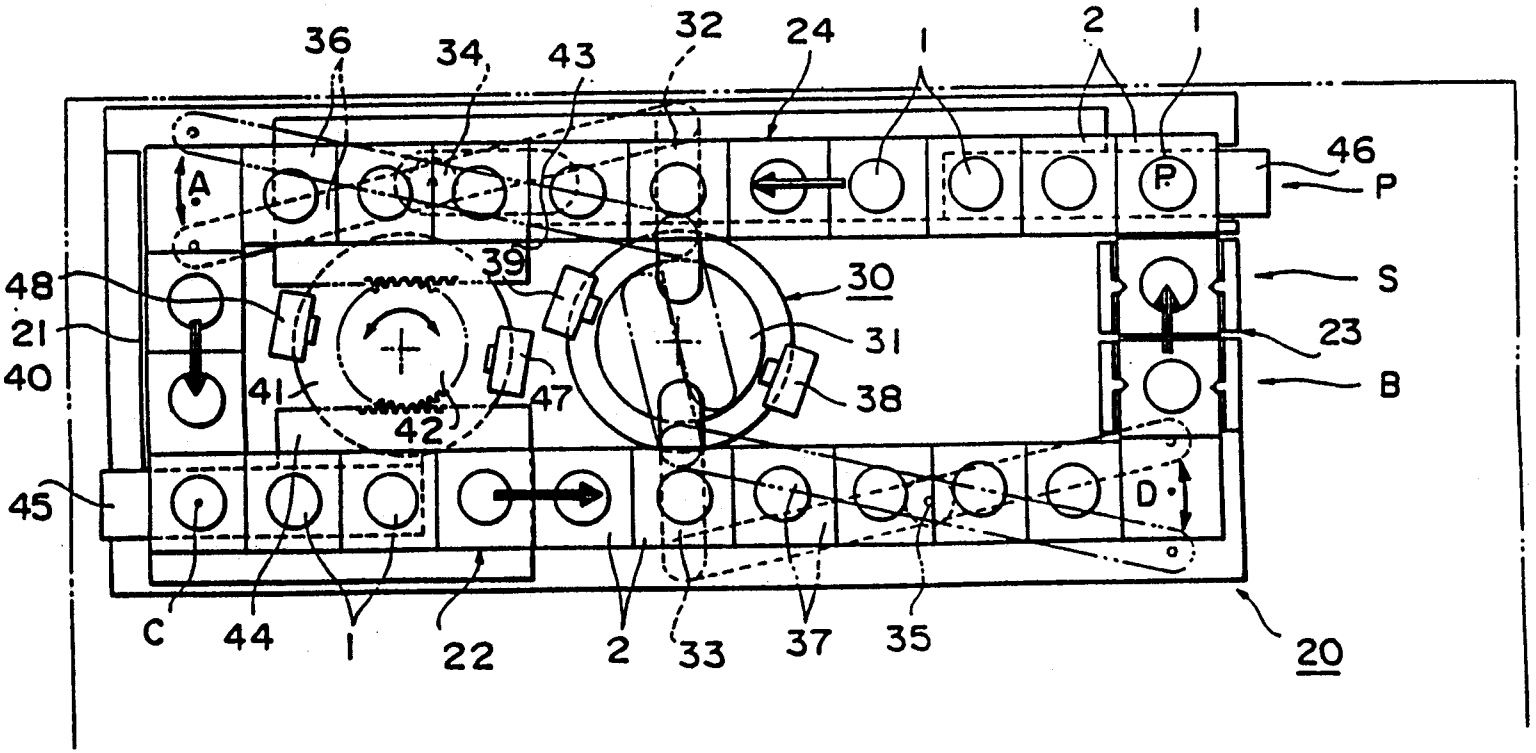
FIG. 3 is a plan view showing a receptacle carrying device.

FIG. 3 shows a carrying direction of the receptacle 1 and the rack 2 holding the receptacle 1, and a relationship between a blood absorbing position P by a pipette (not shown in the figure) and a rotating and oscillating position S. The blood absorbing position P always follows the rotating and oscillating position S, and on way to the rotating and oscillating position S a vacuum breaking position B is located. At the vacuum breaking position B, the remaining vacuum in the receptacle 1 is made equal to atmospheric pressure. The vacuum breaking position B and the rotating and oscillating position S can be exchanged on a proper occasion.

A rack carrying device 20 to carry the receptacle 1 and the rack 2 holding the receptacle 1 comprises a vertical carrying line 21 to carry the rack 2 intermittently from a position A to a position C, a horizontal carrying line 22 to carry the rack 2 intermittently from the position C to a position D, a processing line 23 to carry the rack 2 intermittently from the position D to the vacuum breaking position B, to the rotating and oscillating position S, and to the blood absorbing position P, and a returning line 24 to carry the rack 2, in which a certain absorbing is finished at the blood absorbing position P, intermittently to the position A. Carriage of the rack 2 in the vertical carrying line 21 and the processing line 23 is done by a rack vertical-carrying device 30. The carriage of the rack 2 in the horizontal carrying line 22 and the returning line 24 is done by a rack horizontal-carrying device 40.

The rack vertical-carrying device 30 comprises a circle board 31 to be rotated by a motor (not shown in the figure), effecting arms 32 and 33 each end of which is set on the circle board 31, carrying arms 36 and 37 each end of which is set on the effecting arms 32 and 33 and each middle portion of which is set on axes 34 and 35 to be able to be rotated, and pushing elements set on the other ends of the carrying arms 36 and 37 (not shown in the figure). Numeral 38 and 39 denote position detecting sensors to detect a rotation position of the circle board 31.

In the rack vertical-carrying device 30, the circle board 31 is rotated by the motor, the effecting arms 32 and 33 are moved as shown by imaginary lines in the figure, and the carrying arms 36 and 37 are moved, the axes 34 and 35 being a fulcrum. As a result, the pushing elements set on the end of the carrying arms 36 and 37 push the rack 2 at the position A in the vertical carrying line 21 and at the position D in the processing line 23 to the position C and to the vacuum breaking position B, respectively. In the rack carrying device 20, at a start time of carriage, the rack 2 is not placed at the positions A and D.

The rack horizontal-carrying device 40 comprises a circle board 41 to be rotated by a motor (not shown in the figure), a gear 42 set on the circle board 41, rack gears 43 and 44 to gear into the gear 42, and pushing elements 45 and 46 which are set in the rack gears 43 and 44 and have an L-shape in a front view. Numerals 47 and 48 denote position detecting sensors to detect a rotation position of the circle board 41.

In the rack horizontal-carrying device 40, the circle board 41 is rotated by the motor, the rack gears 43 an 44 to gear into the gear 42 set in the circle board 41 are moved in left and right directions, and by the movement of the rack gears 43 and 44, the pushing element 45 pushes the rack 2 in the horizontal carrying line 22 to the right in the figure, and the pushing element 46 pushes the rack 2 in the returning line 24 to the left in the figure. As a result, the rack 2 in each line is carried on by one to the position D and the position A.

Figure 4:
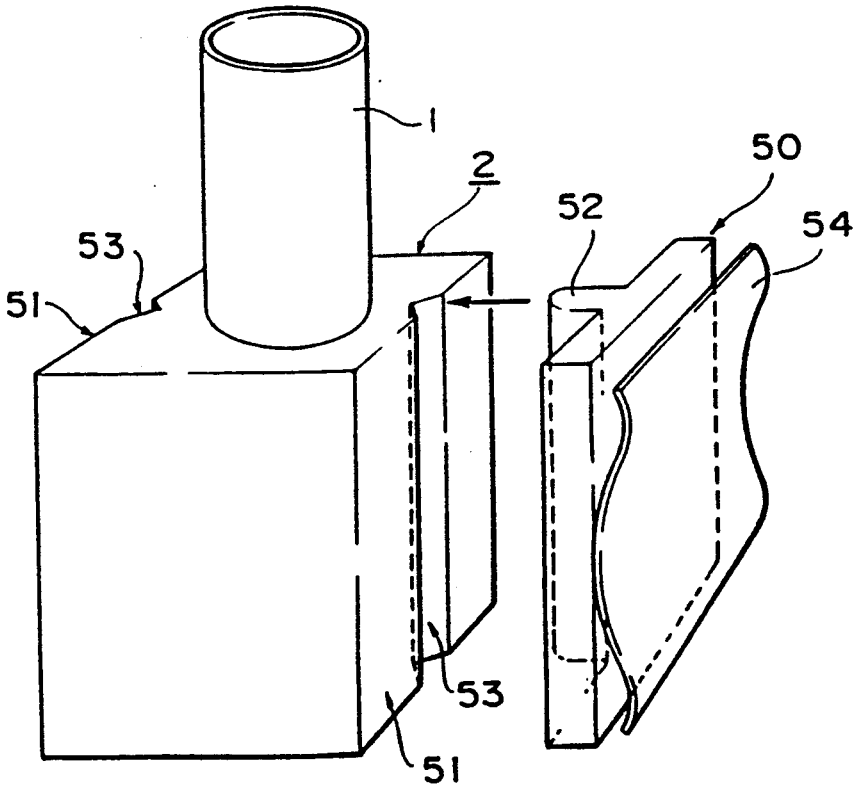
FIG. 4 is an exploded perspective view showing structure of a rack in which a receptacle is held and of a position determining element.

As shown in FIG. 4, in the rack 2 to be carried in the lines 21–24, a V-shape groove 53 is made on a surface 51 to face to a position determining element 50 located in both sides of the vacuum breaking position B and the rotating and oscillating position S in the processing line 23, to determine the position, fitting in a projection 52 in the position determining element 50.

Namely, the projection 52 in the position determining element 50 is normally pushed by a board spring 54 to the processing line 23. When the rack 2 is moved to the vacuum breaking position B and the rotating and oscillating position S by the rack vertical-carrying device 30, the position determining element 50 goes back against the force of the board spring 54 by a plain surface portion of the surface 51 on which the V-shape groove 53 is made, and the processing line 23 is widened. The rack 2 is accordingly allowed to be moved forward. Thereafter, when the V-shape groove 53 in the rack 2 reaches the position of the projection 52 in the position determining element 50, the position determining element 50 goes forward in direction to fit in the V-shape groove 53 by the force of the board spring 54, and the center axis of the receptacle 1 held in the rack 2 is set to be located right under a breaking needle (not shown in the figure) at the vacuum breaking position B and in the oscillation center at the rotating and oscillating position S. After a certain operation is finished at the vacuum breaking position B and at the rotating and oscillating position S, the projection 52 in the position determining element 50 is pushed to the widening direction by the plain surface of the rack by the pushing operation of the rack vertical carrying device 30, and the V-shape groove 53 and the projection 52 are released. Accordingly, the rack 2 can be smoothly moved forward.

According to the automatic sampling device constructed as above, before the blood is absorbed by the pipette, the receptacle 1 held in the rack 2 can be rotated and oscillated. As a result, a precipitated component of blood is stirred before sampling and blood of equal concentration can be absorbed by the pipette.

When blood in the receptacle 1 is absorbed by the pipette of the conventional blood corpuscle counter, for example, if the force of the pipette to pierce the cap 7 on the receptacle 1 is insufficient, namely, the tip of the pipette cannot be soaked in the blood in the receptacle 1, piercing the cap 7, a pushing mechanism 60 shown in FIG. 1, for example, is added.

The pushing mechanism 60 comprises a base 61 and a screw rod 62 set vertically to the base 61. A pushing element 63 to be reciprocated according to the rotation of the screw rod 62 pushes the supporting element to hold the pipette of the blood corpuscle counter. The screw rod 62 is rotated clockwise and counterclockwise by a motor 64. Numeral 65 in FIG. 1 denotes a limit switch located at the highest position and the lowest position of the pushing element 63.

In the pushing mechanism 60 constructed as above, a spring is set in the pipette holding portion in the blood corpuscle counter to adjust an effecting timing of the pipette and the pushing mechanism 60.

The rotating means and the oscillating means in the invention are not limited to the ones shown in FIG. 1. The oscillating means can be implemented by a plane eccentricity cam to be driven by a belt, a solid cam to be driven directly by a motor or slide crank chain, for example. The rotating means can not only be implemented by a system using a pulley and a belt, but also by one to drive the rotor directly by a motor to be moved with the oscillator. The invention is not limited to the stirring device applied to the automatic sampling device in the blood corpuscle counter, but can be applied to other stirring devices.

As explained above, according to the stirring device in the invention, the fluid in a receptacle, even in a receptacle to which a cap is not applied, can be rotated and oscillated to be stirred securely. As a result, even blood corpuscles can be uniformly stirred without any precipitation.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A stirring device system for stirring fluid contained in a receptacle having a longitudinal axis and a cap having an indentation, comprising:

rack means for holding said receptacle, rotor means for selective engagement in said indentation, rotating means coupled to said rotor means for rotating said receptacle about said longitudinal axis of the receptacle, and oscillating means for oscillating said rack about a lateral axis which is noncoincident with said longitudinal axis.

2. A stirring device system according to claim 1, wherein said rotating means comprises:

a first motor located in a rotor supporter, a rod connected to said rotor, and a belt connected to both said rod and said first motor.

3. A stirring device system according to claim 2, further comprising:

a reciprocating means located on an upper portion of said oscillating means for reciprocating said rotor supporter.

4. A stirring device system according to claim 3, wherein the reciprocating means comprises:

a second motor, and a screw rod mounted to said second motor for rotation therewith, said rotor supporter connected to said screw rod.

5. A stirring device system according to claim 4, further comprising: 'a base support said reciprocating device and said rotor, said lateral axis extending within said base.

6. A stirring device system according to claim 1, wherein said oscillating means oscillates about said lateral axis, and wherein said oscillating means is connected to a link means.

7. A stirring device system according to claim 6, wherein said link means comprises:

a third motor, a circle board to be rotated by said third motor, and an effecting arm, wherein, one end of said effecting arm is connected to said circle board and a second end of said effecting arm is connected to said oscillating means.

8. A stirring device system according to claim 1, further comprising:

a rack carrying device for transporting said rack, wherein, said rack carrying device includes, a horizontal carrying line, a vertical carrying line for transporting said rack to said horizontal carrying line, a returning line for transporting said rack to said vertical carrying line, and a processing line for transporting said rack to said returning line.

9. A stirring device according to claim 8, wherein the rack carrying device comprises:

a rack vertical-carrying device including a circle board to be rotated by a motor, effecting arms each comprising an end coupled to the circle board, carrying arms each comprising an end coupled to a respective carrying arm and a middle portion fixed for rotation about an axis, and pushing elements attached to respective other ends of the carrying arms.

10. A stirring device according to claim 8, wherein the rack carrying device comprises:

a rack horizontal-carrying device including a circle board to be rotated by a motor, a gear set affixed to said circle board, rack gears coupled to said gear, and L-shaped pushing elements fixedly attached to said rack gears.

11. A stirring device according to claim 8, wherein, said rack means includes, a first V-shape groove located on a surface of said rack means, and a second V-shape groove located on a different surface of said rack means;

determining element means, including a projection for determining the position of said rack means, in response to positions of said grooves, at a vacuum breaking position and at a rotating and oscillating position in the processing line.

12. A stirring device system according to claim 1, further comprising:

a pushing mechanism for pushing said rack, wherein said pushing mechanism includes:

a base, a screw rod orthogonally coupled to the base and a pushing element coupled to said screw rod.

* * * * *